US005632262A

United States Patent [19]

Hanson

[11] Patent Number: 5,632,262

[45] Date of Patent: May 27, 1997

[54] COMPOUND SLING SHOT

[76] Inventor: Anthony D. Hanson, 1215 N. Main, Aberdeen, S. Dak. 57401

[21] Appl. No.: 586,936

[22] Filed: Jan. 11, 1996

[51] Int. Cl.[6] ..... F41B 3/02

[52] U.S. Cl. ..... 124/20.1; 124/25.6

[58] Field of Search ..... 124/20.1, 20.3, 124/25, 25.6

[56] References Cited

U.S. PATENT DOCUMENTS

| | | | |
|---|---|---|---|
| 1,581,626 | 4/1926 | Barth | 124/20.3 |
| 2,026,199 | 12/1935 | Virneburg | 124/20.3 |
| 4,169,453 | 10/1979 | Hunsicker | 124/20.1 |
| 4,766,874 | 8/1988 | Nishioka | 124/25 |
| 4,879,987 | 11/1989 | Nishioka | 124/25 |
| 4,911,136 | 3/1990 | Brown | 124/20.1 |
| 4,957,093 | 9/1990 | Hamlett | 124/24.1 |
| 5,072,715 | 12/1991 | Barr | 124/20.1 |

*Primary Examiner*—John A. Ricci
*Attorney, Agent, or Firm*—Curtis V. Harr

[57] ABSTRACT

A compound Sling Shot is disclosed. This Sling Shot uses a shortened pair of resilient compound bow limbs which are horizontally mounted to a rigid center body. This body is substantially divided into an upper and lower section. The upper section is supplied with a projectile or barrel hole. The upper section is further equipped to hold the bow limbs in the horizontal plane. The lower section of body is a hand grip having an attached forearm brace. The bow limbs are supplied with cams and a common compound bow string configuration. The firing portion of the string is supplied with a dual string separated by a projectile pouch. In this configuration the dual string holds the projectile pouch in correct position. So as a projectile is fired it passes directly through the projectile or barrel hole on the upper body section. Thus, a sling shot with substantial power and accuracies is disclosed.

8 Claims, 3 Drawing Sheets

COMPOUND SLING SHOT

BACKGROUND OF THE INVENTION

The present invention relates to an improvement in the construction of sling shots used by many in hunting and recreational target shooting. More specifically, the present invention provides for the construction of compound sling shot, a device that is portable, easy to use, and accurate. These objectives are achieved by horizontally mounting a shortened compound bow on top of a grip and forearm brace, thereby replacing the conventional elastic straps commonly used to propel a projectile forward from a sling shot. The end result of this is a powerful and accurate configuration capable of firing the round steel ball projectiles used by sling shots.

In the past, sling shots have had a very limited usefulness in either the hunting or sporting target practice realm, having been predominately relegated to recreational use by children. The major problem with this type of device was that the projectile could not attain a sufficient velocity to make it an effective instrument for hunting and sporting target practice purposes. The reason for this is that the elastic straps traditionally used for propelling projectiles in a sling shot are incapable of generating the force necessary to obtain the velocity required for these activities. Additionally, in the hands of all but the most experienced and skillful user, the conventional sling shot is an inherently inaccurate instrument. This is the result of lack of an accurate and consistent release point in both the horizontal and vertical planes for the projectile. This lack of consistent release point creates an inconsistent trajectory of the projectile upon release by the user.

One type of compound sling shot is described in the Hunsicker U.S. Pat. No. 4,169,453 patent. This compound sling shot uses a complex system of pulleys along with a coil type spring. The result is that the shot may not be made in a smooth motion and many of the inherent inaccuracies of a standard sling shot are carried over into this type of sling shot. Specifically, the projectile when released is not carried through in a single plane but may vary vertically depending upon the user's draw much as in a standard sling shot.

Another type of compound sling shot is shown by the Brown U.S. Pat. No. 4,911,136. This sling shot also contains inherent inaccuracies as the projectile is not launched in the same plane as the resilient limbs move. As such, a complicated system of pulleys is required to redirect the forces of the resilient limbs into another plane.

Traditionally, both the compound bow and the cross bow are limited to the use of arrows as ammunition. The problem with this is that arrows are very expensive, typically costing as much as one hundred dollars a dozen. Also, arrows are relatively large and awkward in transport, limiting the number that can be carried in the field. As a result, the loss of arrows in the field not only represents a significant financial loss to the user, but also severely reduces his ammunition reserves, thereby limiting his effective time in the field.

Other problems exist with the compound bow and the cross bow. The compound bow is a typically large device and can often be difficult to manipulate and fire in densely wooded areas in a hunting situation. While the cross bow is more compact, it lacks the fire power of the compound bow and it is significantly more difficult and time consuming to load an arrow into. As a consequence, crossbows are seldom used by sportsman in hunting and target shooting situations.

The size problem with compound bows was partially remedied by the Hamlett U.S. Pat. No. 4,957,093. This patent describes a compound bow rotatably mounted on a pistol grip. However, this device still contains all of the drawbacks associated with the use of arrows.

From the foregoing discussion it can be seen that it would be highly desirable to provide a method of combining the velocity producing attributes and effectiveness of a compound bow with the simplicity and ease of use of a sling shot and further the accuracy of a cross bow. Additionally, it would be desirable to provide such a device that is capable of using inexpensive, readily available, and compact ammunition such as round steel shot. It is further desirable to provide such a device that is compact in its external dimensions and therefore easily used in the densely wooded areas commonly encountered in hunting.

SUMMARY OF THE INVENTION

It is the primary objective of the present invention to provide a method of increasing a projectile's velocity when released from a hand held and forearm braced hunting or target shooting sling shot.

Additionally, it is an objective of the present invention to provide a manner of increasing the accuracy of a projectile's trajectory when released from a hand held hunting or target shooting sling shot.

It is a further objective of the present invention to combine the favorable attributes of several weapons into a new projectile launching weapon. These attributes include decreasing the draw weight of the bow string while increasing the projectile velocity, allowing the use of less expensive ammunition and ease in transport and creating a stable configuration for accuracy in the firing of a projectile.

The present invention addresses these problems by horizontally mounting a pair of shortened resilient limbs separated by a rigid body on top of a sling shot style handle equipped with a forearm brace. This configuration is compact and therefore easily transportable and combines the power and effectiveness of the compound bow with the accuracy of the cross bow. Additionally, the present invention is designed to use round, small steel shot as ammunition therefore allowing the user to easily carry an almost inexhaustible supply of inexpensive ammunition.

More specifically these objectives are accomplished by the use of a shortened pair of resilient compound bow limbs which are horizontally mounted to a rigid center body. This body is substantially divided into an upper and lower section. The upper section is supplied with a projectile or barrel hole. The upper section is further equipped to hold the bow limbs in the horizontal plane. The lower section of body is a hand grip having an attached forearm brace. The bow limbs are supplied with cams and a common compound bow string configuration. The firing portion of the string is supplied with a dual string separated by a projectile pouch. The weapon is further supplied with retainer rod which holds the bow string in position so as not to interfere with the projectiles line of travel. In this configuration the dual string holds the projectile pouch in the correct position, causing a projectile to pass directly through the projectile or barrel hole on the upper body section.

The aforementioned configuration allows the user to place his hand through the wrist strap or forearm brace portion of the present invention while the strap presses in a downward fashion on the forearm. This divides the force developed during the use of the said invention between the hand and the forearm, providing stability and ease in use. The utilization of the compound bow limbs supplied with cams increases the velocity of the projectile fired from the present invention and also greatly reduces the wide range of possible trajectories of said projectile upon release. This is accomplished by having only one possible release point on the vertical plane and only one point on the horizontal plane, thereby increasing the user's ability to aim the device effectively.

The present invention utilizes a shortened version of the compound bow, resulting in a device that is smaller and easily transportable, especially when used in wooded areas with dense vegetation common in many hunting locales. Additionally, because the present invention allows the use of a small, round projectile as ammunition, the user can avoid transporting cumbersome arrows traditionally used with a conventional compound bow.

For a better understanding of the present invention reference should be made to the drawings in which there is illustrated and described preferred embodiments of the present invention.

DESCRIPTION OF THE PREFERRED EMBODIMENT

Figure 1:
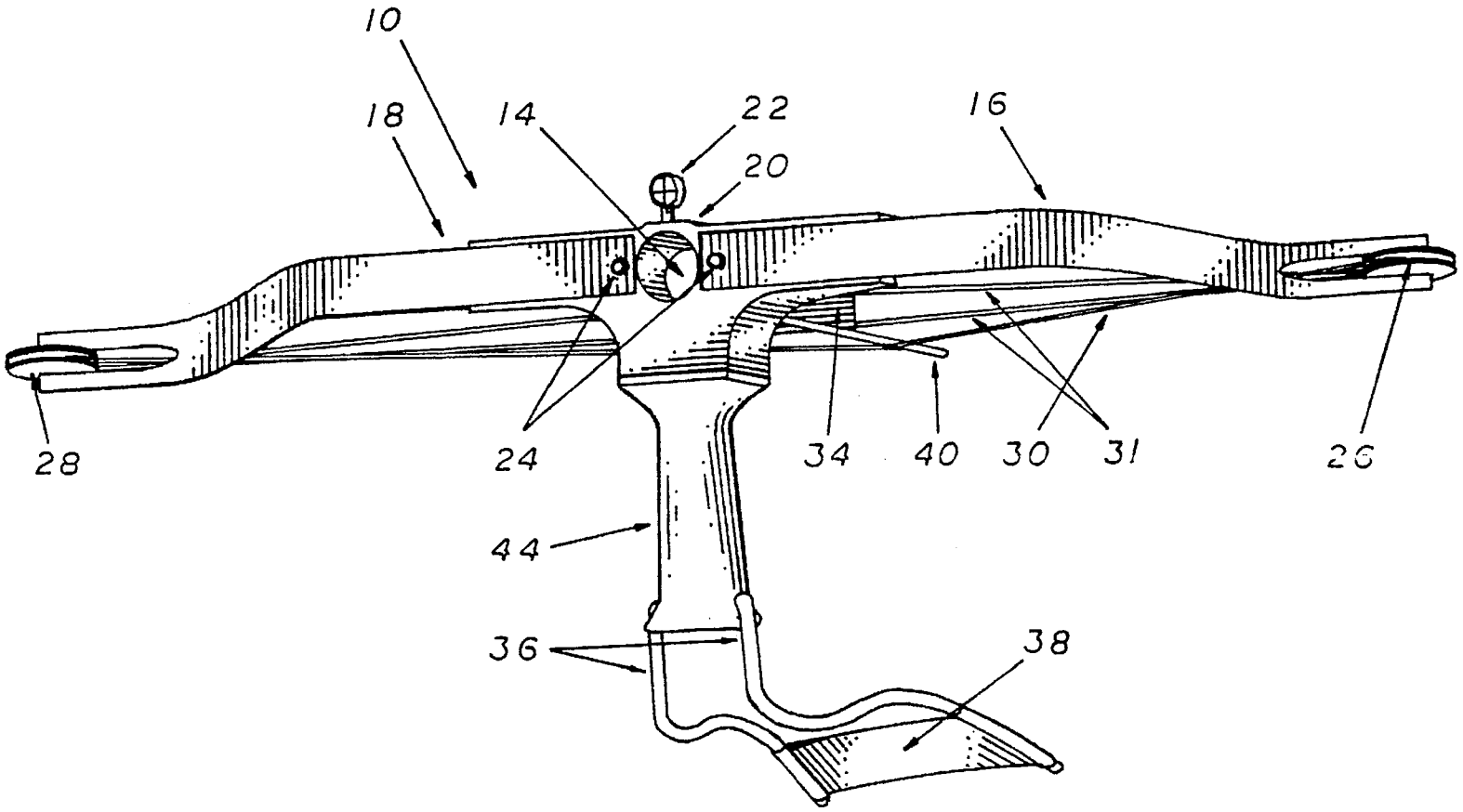
FIG. 1 is a front elevation perspective view of the Compound Sling Shot showing the orientation and relationship of the compound bow section, the handle, and the forearm strap of the present invention.
Figure 2:
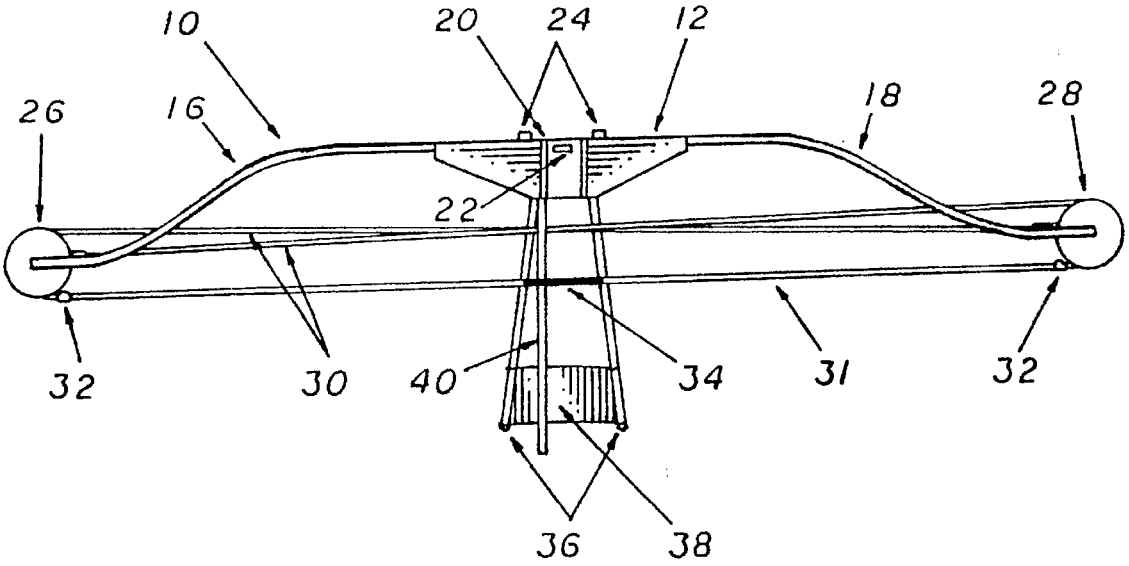
FIG. 2 is a top elevation view of the present invention showing the pulley mechanisms of the compound bow section and its horizontal relationship to the wrist rocket portion of said invention.
Figure 3:
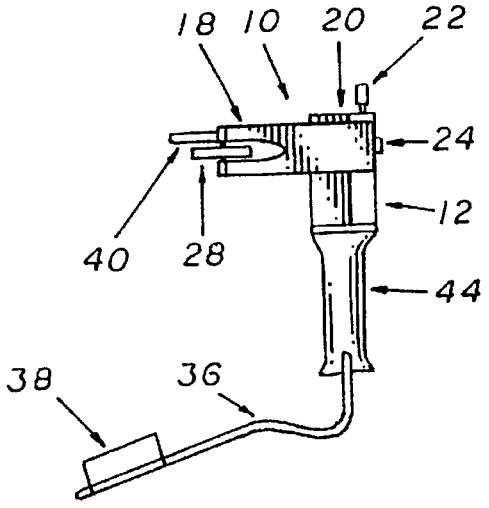
FIG. 3 is a side elevation view of the present invention showing the vertical relationship between the compound bow section and the wrist rocket section of said invention.

Referring now to the drawings, and more specifically to FIG. 1, 2, and 3, the base of the Compound Sling Shot 10 is the handle 44, including the wrist brackets 36 and the wrist strap 38. The milled rigid body 12 of the present invention may be made of aluminum or some other suitable material. The rigid body 12 is permanently mounted to the upper most surface of the handle 44. The body 12, then provides the mounting point for the left resilient bow limb 16, the right resilient bow limb 18, and the site 22 which is located on the upper most surface of the body 12 on top of the site ridge 20. Also centrally located in the body 12 is the ammunition hole 14 which allows for the projectiles to pass through the body 12 when fired.

The left and right resilient bow limbs, 16 and 18, are securely attached to the body 12 of the Compound Sling Shot 10 by means of the arm anchor bolts 24. This attachment is accomplished by passing the anchor bolts 24 through the left and right resilient bow limbs, 16 and 18, at their respective most inward ends. The left and right resilient bow limbs, 16 and 18, then extend outward from these points in a backwardly curved fashion, where, at their most outward extremities, they are attached the left compound pulley 26 and the right compound pulley 28 respectively.

The draw string 30 is centrally attached at one end to the left compound pulley 26 where it then passes through the left resilient bow limb 16 and extends laterally down the horizontal length of the Compound Sling Shot 10 after passing underneath of the draw string retainer rod 40 which is centrally attached to and extends reward from the rear lateral surface of the body 12. After passing underneath the draw string retaining rod 40, the draw string 30 then passes through the right resilient bow limb 18 where it the engages the right compound pulley 28 at its most forward edge and encircles said pulley's outside edge in a 180 degree fashion to a point on the most inward edge of the right compound pulley 18.

At this point, the draw string 30 extends back down the horizontal length of the present invention to a point where it engages the inward edge of the left compound pulley 16. It again encircles the left compound pulley in a 180 degree fashion and passes underneath the draw string retainer rod 40 before passing through the right resilient bow limb 18 and finally being centrally attached to the right compound pulley 28.

Also attached to the draw string 30 at the point where it engages the inward edge of left and right compound pulleys, 26 and 28, are the draw string stops 32, which limit vibration of the draw string 30 upon release of a projectile. In addition, the ammunition pouch 34, which is mounted centrally between the two sides of the double separated string portion 31, is the point from which the ammunition is released upon firing. Thus the ammunition pouch 34 is centrally attached on the section of the double string 31 which extends between the inward edges of the left and right compound pulleys, 26 and 28.

Figure 4:
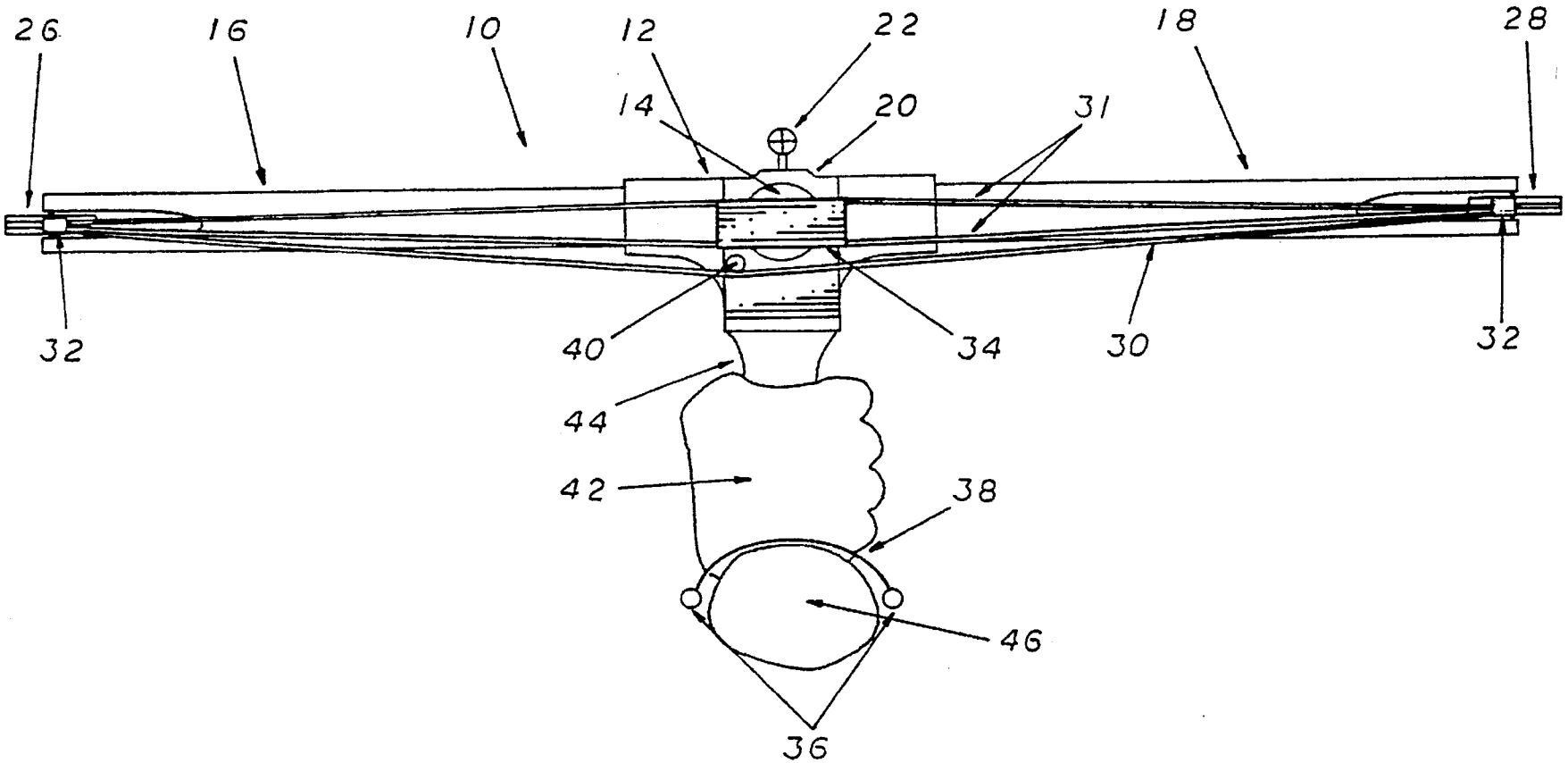
FIG. 4 is a back elevation view of the present invention showing the orientation of its major components and the manner in which a user places his hand onto said invention during its operation.

The manner in which the Compound Wrist Rocket is used is illustrated by FIG. 4. The user, from underneath, passes his hand 42 through the wrist brackets 36 between the wrist strap 38 and the handle 44. He then grasps the handle 44 with his hand 42 and the wrist strap rests firmly on top of his wrist 46. After placing a projectile in the ammunition pouch 34 and firmly holding the two between two fingers on his free hand, he then pulls the draw string 30 towards him. This has the effect of bending the left and right resilient bow limbs, 16 and 18, in a backward fashion through the left and right compound pulleys, 26 and 28. The user then aims through the site 22 and releases his hold on the ammunition pouch 34. This releases the tension on the resilient bow limbs, 16 and 18, which snap back to their original position propelling the ammunition through the ammunition hole 14 in the body 12 and to the target.

Although the present invention has been described in considerable detail with reference to certain preferred versions thereof, other versions are possible. Therefore, the spirit and scope of the appended claims should not be limited to the description of the preferred versions contained herein.

What is claimed is:

1. A compound Sling Shot comprising:

a central rigid body having an upper and lower portion, said upper portion having a left and right limb brace and further defining a projectile opening, said lower portion defining a vertical hand grip;

a left and right resilient bow limb;

a means of attaching said left and right resilient bow limbs to said respective left and right limb brace so that said resilient bow limbs extend outward in the horizontal plane from said limb braces;

a left and right cam system rotatably attached to said left and right resilient bow limbs opposite of said limb braces;

a tensionable string attached about said cams;

said string having a double separated string portion centered between said cams;

a projectile pouch positioned on said double separated string centered between said cams;

a means of attaching said pouch to said string; and a forearm brace attached to the bottom of said lower body portion.

2. A Compound Sling Shot as in claim 1 wherein said pouch is center mounted between said double separated string which is in turn centered between said cams.

3. A Compound Sling Shot as in claim 2 further comprising a string retainer rod extending rearward and perpendicular from said central body.

4. A Compound Sling Shot as in claim 3 further comprising a cross hair sight fixedly attached to the top of said upper body portion.

5. A Compound Sling Shot as in claim 4 wherein said projectile opening is cylindrical in shape.

6. A Compound Sling Shot comprising:

a central rigid body having an upper and lower portion, said upper portion having a left and right limb brace and further defining a cylindrical projectile opening, said lower portion defining a vertical hand grip;

a left and right resilient bow limb;

a means of attaching said left and right resilient bow limbs to said respective left and right limb brace so that said resilient bow limbs extend outward in the horizontal plane from said limb braces;

a left and right cam system rotatably attached to said left and right resilient bow limbs opposite of said limb braces;

a tensionable string attached about said cams, said string further having a double separated string portion which is centered between said cams;

a projectile pouch center positioned on said double separated string portion;

a forearm brace attached to the bottom of said lower body portion; and a string retainer rod extending rearward and perpendicular form said central body.

7. A Compound Sling Shot as in claim 6 wherein said means of attaching said left and right resilient bow limbs to said respective left and right limb brace is a bolt.

8. A Compound Sling Shot as in claim 7 further comprising a cross hair sight fixedly attached to the top of said upper body portion.

* * * * *